United States Patent [19]

Green

[11] Patent Number: 4,662,384

[45] Date of Patent: May 5, 1987

[54] SMOKING ARTICLES

[75] Inventor: John D. Green, Romsey, England

[73] Assignee: British-American Tobacco Company Limited, London, England

[21] Appl. No.: 506,655

[22] Filed: Jun. 22, 1983

[30] Foreign Application Priority Data

Jun. 29, 1982 [GB] United Kingdom ..... 8218773

[51] Int. Cl.[4] ..... A24D 3/12; A24D 3/14

[52] U.S. Cl. ..... 131/335; 131/331; 131/342

[58] Field of Search ..... 131/335, 342, 343, 331, 131/336, 352

[56] References Cited

U.S. PATENT DOCUMENTS

| | | | |
|---|---|---|---|
| T901,024 | 8/1972 | Sloan et al. | 131/336 |
| 1,972,718 | 9/1934 | Sharlit | 131/331 |
| 3,292,636 | 12/1966 | Mays | 131/352 |
| 3,572,348 | 3/1971 | Norman et al. | 131/352 |
| 3,603,319 | 9/1971 | Badgett et al. | 131/342 |
| 3,658,069 | 4/1972 | Wise et al. | 131/343 |
| 3,972,335 | 8/1976 | Tiggelbeck et al. | 131/342 |
| 4,311,156 | 1/1982 | Bonnet et al. | 131/335 |
| 4,363,333 | 12/1982 | Matkin | 131/342 |
| 4,397,321 | 8/1983 | Stuetz | 131/342 |

FOREIGN PATENT DOCUMENTS

| | | |
|---|---|---|
| 1448989 | 7/1966 | France . |
| 1570621 | 6/1969 | France . |

*Primary Examiner*—V. Millin
*Assistant Examiner*—H. Macey
*Attorney, Agent, or Firm*—Kane, Dalsimer, Kane, Sullivan and Kurucz

[57] ABSTRACT

A smoking article, such as a cigarette, has a filter which incorporates a volatile smoke-modifying agent. The filter comprises zeolite granules impregnated with the volatile agent. A cavity-type of filter may contain between 10 and 200 mg of mentholated zeolite granules. The loading level of a menthol on the zeolite granules may be within a range of from 3 to 60 mg/g. Cellulose-acetate plugs may be provided at the ends of the filter cavity.

1 Claim, 3 Drawing Figures

SMOKING ARTICLES

Figure 1:
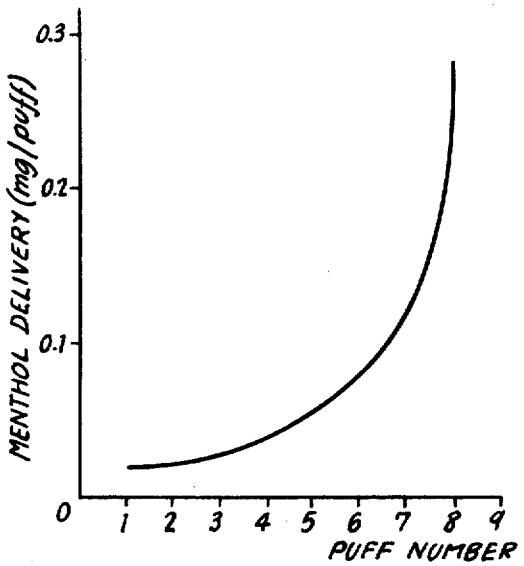

This invention relates to a smoking article incorporating a smoke-modifying agent. By a smoke-modifying agent in this Specification and the appended claims is meant an agent which imparts a flavour and/or other subjectively appreciated effect to mainstream smoke drawn from the article.

It is a well established practice to incorporate extraneous flavourant materials in smoking articles. Among flavourants added to cigarettes, one of the most commonly used is menthol. Among ways which have been proposed for incorporating menthol in cigarettes, a method often practiced for producing mentholated cigarettes is to apply menthol to the tobacco prior to cigarette manufacture. Thus, for example, UK Patent Specification No. 1,357,057 describes a method in which an alcoholic solution of menthol is sprayed onto a layer of tobacco formed on a cigarette-making machine just up-stream of the entry point of the layer into the rod-making garniture of the machine. However, the spraying of tobacco with a volatile material presents the problem that such a material is liable to contaminate the machine, so that, unless the machine is scrupulously cleaned, cigarettes subsequently made on the machine which were not intended to incorporate the volatile material will in fact be tainted with the material. Another problem that may be encountered when a volatile flavourant is sprayed onto cigarette tobacco is that, during storage of cigarettes manufactured from the tobacco, the flavourant is liable to volatilize and thus be lost from the cigarette.

Proposals have been made to ameliorate these problems by incorporating volatile flavour materials in the filters of filter-tipped cigarettes, the flavour materials being impregnated on granular or particulate carrier materials. In U.S. Pat. No. 3,603,319, for example, there is a disclosure of the concept of absorbing menthol or other flavourants on organic polymer granules and incorporating the granules in cigarette filters. As is apparent from the examples given in U.S. Pat. No. 3,603,319, a drawback of this concept resides in the fact that, of the flavourant on the polymer granules, only small amounts, typically about 11%, are transferred to the main-stream smoke. This clearly represents an uneconomic use of flavourant material. A similar proposal is made in United Kingdom Patent Specification No. 2,054,341A, according to which granular magnesium is used as a carrier for menthol. The same defect, however, is exhibited as with the polymer granules of U.S. Pat. No. 3,603,319, that is to say the menthol is held too retentively by the carrier and only small amounts of menthol are transferred to the mainstream smoke.

An object of the present invention is to provide a smoking-article filter in the use of which a flavourant incorporated in the filter is transferred to the mainstream smoke in amounts which are acceptably large as percentages of the amount of flavourant added to the filter.

The present invention provides a smoking-article filter comprising zeolite granules impregnated with a volatile smoke-flavouring or modifying agent, menthol for example.

The invention is based on the discovery that zeolite granules possess acceptable retention properties for volatile smoke-modifying agents whilst releasing a higher proportion of the agent into the tobacco smoke than is the case with prior proposed granular carrier materials.

Filter cigarettes of which the filters contained magnesium silicate granules impregnated with menthol have been examined. The tobacco rod of each of these cigarettes was 63 mm long and the filters 20 mm long, each filter comprising an 8 mm long paper filter plug abutting the tobacco rod and a 7 mm long cellulose acetate filter plug at the mouth end of the filter, the two plugs bounding an intermediate cavity in which magnesium silicate granules were disposed. The loading level of menthol on the granules was approximately 56 mg/g. The weight of the granules in each filter was about 122 mg.

In order to determine the degree of transfer of menthol to mainstream smoke, the cigarettes were machine smoked, under standard smoking conditions of one 35 $cm^3$ puff of 2 seconds duration each minute, the smoke being discontinued at a tobacco rod butt length of 8 mm. The smoke was drawn from the cigarettes through Cambridge filter pads. Measurements made of the amounts of menthol in the total particulate matter (TPM) collected on the filter pads, in the vapour phase of the smoke, in the magnesium silicate granules and in the filter plugs indicated that after smoking, 65% of the methol in each cigarette before smoking was still retained by the granules and that 20% resided in the filter plugs. As to the smoke, 7% transferred to the TPM and no measurable amount was found in the vapour phase. The amount of menthol on the granules after smoking was 86% of the amount of menthol on the granules before smoking.

It was thus clearly demonstrated that although magnesium silicate possesses a good retention property with respect to menthol, the degree of transfer of menthol from the granules to the mainstream smoke was very low. This means that to ensure the attainment of a desired level of smoke mentholation, a large excess menthol loading on the magnesium silicate granules is necessitated.

In the accompanying drawings,

FIG. 1 shows a graph which illustrates menthol present in the mainsteam TPM per mg/puff plotted against puff numbers for the above described examination of filter cigarettes whose filters contained menthol-impregnated magnesium silicate granules.

Figure 2:
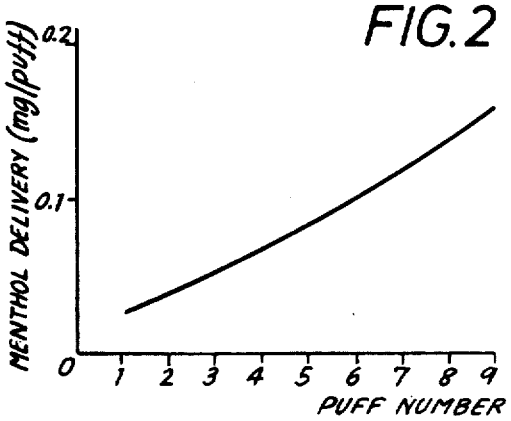
Figure 3:
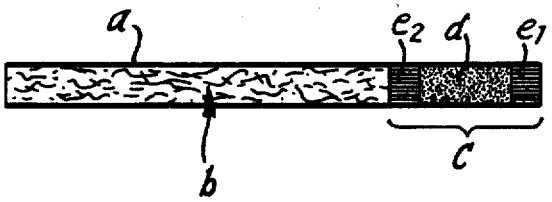

FIG. 2 of the drawings shows a graph for puff-by-puff levels of menthol in the mainstream smoke of filter cigarettes, produced in accordance with a preferred embodiment of the present invention, as described with reference to FIG. 3 of the accompanying drawings.

As may be seen, the menthol delivery per puff in FIG. 1 increases very rapidly, especially over the last few puffs.

In order to investigate the suitability of zeolites as carriers for menthol in cigarette filters, a construction of filter cigarettes (FIG. 3) was used having, within a wrapping a, a 64 mm long tobacco rod b and a further element c comprising a 15 mm long cavity d containing specified mentholated zeolite granules, and bounded by 5 mm long cellulose-acetate plugs, $e_1$ and $e_2$ respectively, at the mouth and tobacco ends.

The zeolites employed, in each case with 100 mg of selected mentholated zeolite granules in the cavity, were obtained from Anaconda Copper Co Ltd under the designations 1010A(i), 1010A(ii), 2020A and 5050L, the respective initial loading levels of menthol on these zeolites being 4.7, 36.4, 91.6 and 48.2 mg/g of zeolite.

Determinations were made of the total amount of menthol in samples of the zeolite-containing cigarettes just before others of these cigarettes were smoked. The results are shown in Table 1.

TABLE 1

| Zeolite | Menthol (Mg/cigarette) |
|---|---|
| 1010A (i) | 0.21 |
| 1010A (ii) | 1.55 |
| 2020A | 6.37 |
| 5050L | 1.74 |

The zeolite-containing cigarettes were machine smoked under the aforesaid standard conditions and measurements were made of the menthol transferred to the mainstream TPM. The results are shown in Table 2.

TABLE 2

| Zeolite | Menthol in TPM (% of menthol/cigarette before smoking) |
|---|---|
| 1010A (i) | 37 |
| 1010A (ii) | 29 |
| 2020A | 24 |
| 5050L | 36 |

The levels of menthol transfer to mainstream smoke which are indicated in Table 2 are substantially in advance of the 7% transfer obtained when magnesium silicate granules were employed as the carrier for menthol.

FIG. 2 shows the graph for puff-by-puff levels of menthol determined for the cigarettes containing the 1010A (ii) zeolite. As is evident from FIG. 2, the menthol delivery per puff increases in a proportionate manner, there is no accelerated build-up of TPM menthol in the last few puffs as was the case, (FIG. 1) with the cigarettes containing magnesium silicate.

It will be understood that the invention is not to be construed as limited to the described embodiments: For example, the filter may contain between 10 and 200 mg of mentholated zeolite granules per cavity of a cavity-type filter. Furthermore, the loading level of menthol on the zeolite granules may be within a range of from 3 to 60 mg/g. Moreover, the zeolite granules may be admixed with material of a different composition, which may also be in granular form. For example, the material of a different composition may comprise a smoke filtration material.

I claim:

1. A smoking article having a filter including zeolite granules impregnated with a volatile smoke-modifying agent comprised of menthol, wherein the filter contains between 10 and 200 mg of zeolite granules and the loading level of the menthol on the zeolite granules is within a range of from 3 to 60 mg/g.

* * * * *

UNITED STATES PATENT AND TRADEMARK OFFICE

CERTIFICATE OF CORRECTION

PATENT NO. : 4,662,384

DATED : May 5, 1987

INVENTOR(S) : John D. Green

It is certified that error appears in the above—identified patent and that said Letters Patent is hereby corrected as shown below:

Col. 4, Claim 1, line 6 of Claim 1; after "60 mg/g" and before the period insert --, said article upon being lit and smoked, transferring at least 24 percent of the loaded menthol to the mainstream smoke --

Signed and Sealed this

Twenty-eighth Day of June, 1988

*Attest:*

DONALD J. QUIGG

*Attesting Officer*

*Commissioner of Patents and Trademarks*